United States Patent [19]

Roche et al.

[11] Patent Number: 4,700,548

[45] Date of Patent: Oct. 20, 1987

[54] CONTROL APPARATUS FOR ICE RINK REFRIGERATION EQUIPMENT

[75] Inventors: Richard G. Roche, Milton; Russell Blades, Burlington, both of Canada

[73] Assignee: Ontario, Inc., Burlington, Canada

[21] Appl. No.: 836,299

[22] Filed: Mar. 5, 1986

[51] Int. Cl.[4] ..... F25D 17/02

[52] U.S. Cl. ..... 62/139; 62/201; 62/435

[58] Field of Search ..... 62/201, 185, 235, 138, 62/139, 435, 98; 237/63

[56] References Cited

U.S. PATENT DOCUMENTS

| | | | |
|---|---|---|---|
| 2,349,671 | 5/1944 | Newton | 62/185 X |
| 2,973,630 | 5/1957 | Kriechbaum . | |
| 3,484,805 | 2/1966 | Lorenz . | |
| 3,608,818 | 9/1971 | Von Fellenberg | 237/63 X |
| 3,658,124 | 4/1972 | Tippmann | 62/235 X |
| 4,151,725 | 5/1979 | Kountz et al. | 417/32 |
| 4,171,771 | 10/1979 | Colthorpe | 237/8 R |
| 4,319,462 | 3/1982 | Foster | 62/235 |
| 4,497,181 | 6/1983 | Kocher et al. . | |

FOREIGN PATENT DOCUMENTS

| | | | |
|---|---|---|---|
| 1171454 | 3/1981 | Canada . | |
| 1150107 | 6/1963 | Fed. Rep. of Germany | 62/235 |

*Primary Examiner*—William E. Wayner

*Attorney, Agent, or Firm*—Lee C. Robinson, Jr.

[57] ABSTRACT

The present invention comprises methods and apparatus for controlling the speed of a motor for a piece of ice slab refrigeration equipment, in response to variations in thermal load on the ice slab. The control apparatus comprises thermal load sensing means and motor drive means. The thermal load sensing means detects variations in the thermal load on the ice slab and generates an output signal correlatable with such variations. The motor drive means is operatively coupled to the thermal load sensing means and is connectable to the motor and drives the motor at various speeds correlatable with the variations in ice slab thermal load. The control apparatus of the present invention is particularly adapted to control the speed of an alternating current induction motor of a centrifugal brine pump motor. The thermal load sensing means preferably comprises temperature detecting means such as a resistance temperature detector for detecting the fluctuations in the brine temperature, and drive control means such as a signal transmitter for generating a reference signal for input into the motor drive means, which preferably comprises a variable speed drive. Incorporating the control apparatus of the present invention into existing ice rink refrigeration systems is expected to drastically reduce operating costs.

10 Claims, 4 Drawing Figures

CONTROL APPARATUS FOR ICE RINK REFRIGERATION EQUIPMENT

FIELD OF THE INVENTION

This invention relates to methods and apparatus for controlling ice rink refrigeration equipment, and more specifically, for controlling the speed of a brine pump motor.

BACKGROUND

Refrigeration equipment for ice rinks (including outdoor and indoor hockey, skating and curling rinks) typically comprises a refrigeration compressor, a brine chiller, a brine-to-ice heat exchanger usually embedded in a substrate below the ice, brine lines and a brine pump for circulating the refrigerated brine through the heat exchanger. The operation of ice slab refrigeration equipment requires a significant amount of power. For example, refrigerator compressors of about a one hundred horsepower capacity (i.e. 77 tons), operating about 50% of the time on the average throughout the year, are required to maintain good ice quality in the case of a single ice rink located in a typical community centre. The average cost for operating refrigeration equipment for a typical ice rink is now in the thousands of dollars monthly, and this cost is expected to increase with ever escalating energy costs. Accordingly, there is an increasing need to improve the energy efficiency of ice rink equipment.

The brine pump of a conventional ice rink refrigeration system operates continuously at a constant speed (usually about 1800 RPM). Heretofore, no attempt had been made to vary the speed of the brine pump, perhaps because of concerns over reduced ice quality or perhaps because it was felt that little energy savings could be achieved by modifying the brine pump because the cost of running the brine pump is rather less than the cost of running the refrigerator compressor.

SUMMARY OF THE INVENTION

The present inventors have found that it is possible to reduce ice rink refrigeration energy costs by varying the speed of the brine pump, without sacrificing ice quality. The present inventors have realized that (a) the capacity of the brine pump motor is selected based upon the maximum heat load on the ice slab, so that the brine pump is over-designed during off-peak load times; and (b) the flow rate of a brine pump is proportional to the cube of the power consumption, so that a relatively small decrease in pump flow rate can result in substantially less power consumption (unlike the refrigerator compressor whose output is directly proporational to its power consumption). Moreover, the present inventors have recognized that existing systems with constant speed brine pumps can be modified at a relatively modest cost with relatively few changes, by apparatus which automatically adjust the speed of the brine pump motor in response to changes in the thermal load on the ice slab.

Accordingly, the present invention is directed to control apparatus for controlling the speed of an ice slab refrigeration equipment motor, such as a brine pump motor, in response to variations in thermal load on the ice slab. The control apparatus comprises thermal load sensing means for detecting the variations in ice slab thermal load and for generating an output signal correlatable with the thermal load variations, and motor drive means responsive to the termal load sensing means and connectable to the motor for driving the motor at various speeds correlatable with the variations in ice slab thermal load.

The control apparatus of the present invention is particularly adapted for controlling the speed of an alternating current centrifugal brine pump motor, although it could also be used for other types of motors. The thermal load sensing means preferably comprises brine temperature detecting means for detecting fluctuations in the brine temperature, and drive control means responsive to the brine temperature detector for generating a reference signal for input into the motor drive means, which preferably comprises a variable speed drive.

Alternatively, the thermal load sensing means could comprise an ice slab temperature sensor placed within the ice slab, and a set point controller for controlling the operation of the variable speed drive.

The invention will now be described, by way of example only, with reference to the following drawings, in which.

DETAILED DESCRIPTION OF THE PREFERRED EMBODIMENT

Figure 1:
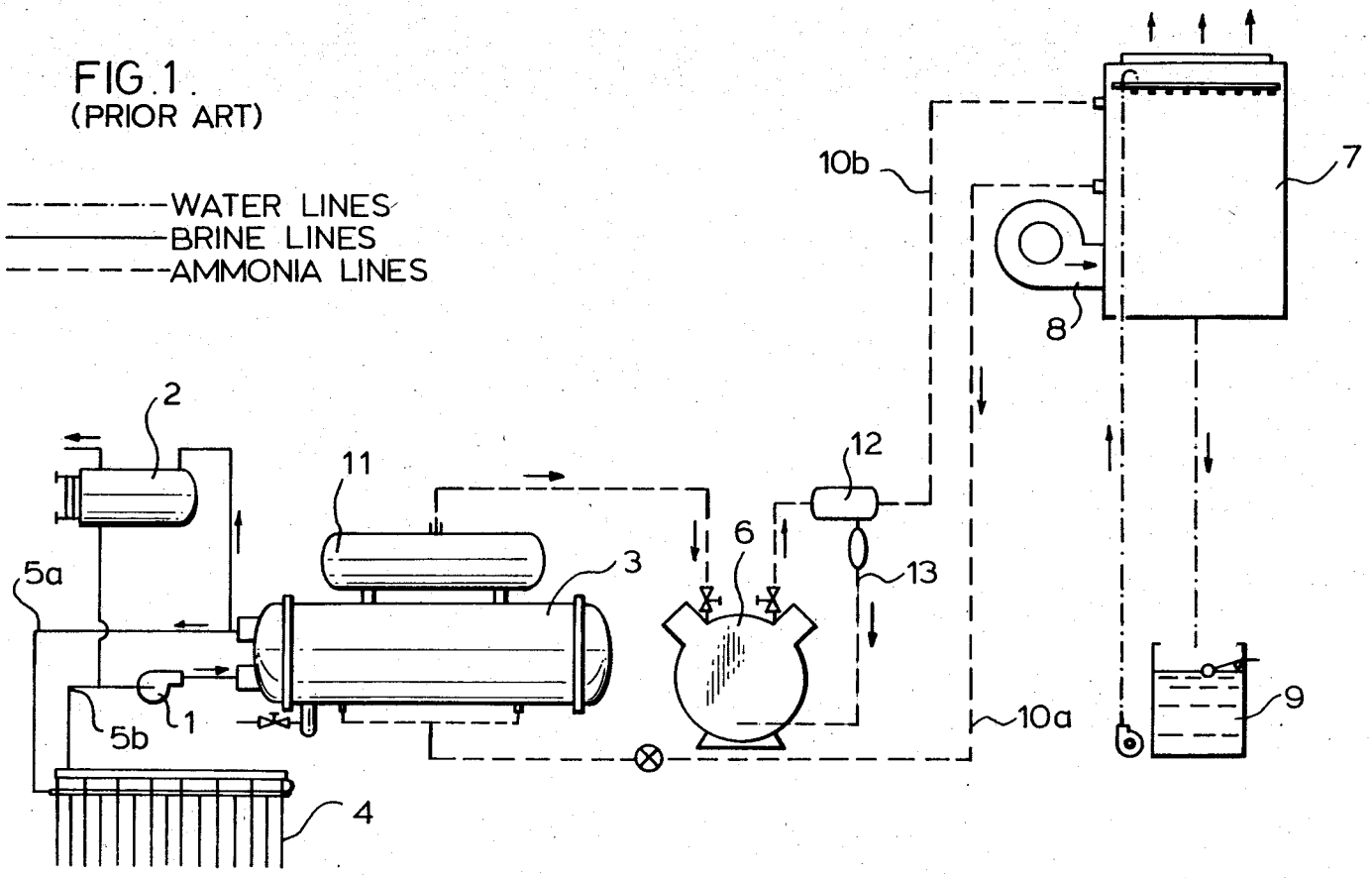
FIG. 1 (PRIOR ART)
FIG. 1 is a block diagram of a typical ice slab refrigeration system (prior art).

FIG. 1 illustrates the typical layout of a refrigeration system for an ice rink. Brine pump 1 circulates calcium chloride brine from brine storage tank 2 through brine chiller 3 and rink floor piping 4 via brine lines 5*a*,5*b*. Within chiller 3 are tubes around which circulate an ammonia or freon refrigerant cooled by means of a refrigeration compressor 6 and condenser 7. Associated with condenser 7 are condenser fan 8 and water tank 9. The refrigerant circulates through condenser 7 to chiller 3 via refrigerant line 10*a*, and through surge drum 11, compressor 6, and oil separater 12 via regrigerant line 10b. Separated oil is returned to compressor 6 via oil return line 13. The brine inside chiller 3 is cooled by heat transfer between the brine and the refrigerant. The refrigeration compressor 6 is typically cycled on and off as needed to keep the brine cold.

The cooled brine from chiller 3 flows through input brine line 5*a* (usually about six inches in diameter) into rink floor piping 4, which is typically small diameter thermoplastic pipe embedded in a concrete or sand flooring onto which is poured water for making ice. The brine passes through piping 4, which is typically evenly spaced throughout the flooring, and heat from the ice is transferred to the brine as it circulates through piping 4. Warmed brine travels back to brine pump 1 via exit brine line 5*b*. Valves may be placed at appropriate places in the brine lines in order to faciliate removal of the pump from the system for repair. Brine pump 1 is typically a centrifugal pump powered by a standard "squirrel cage" induction alternating current motor 14 (see FIG. 2) usually operating close to 1800 RPM.

Figure 2:
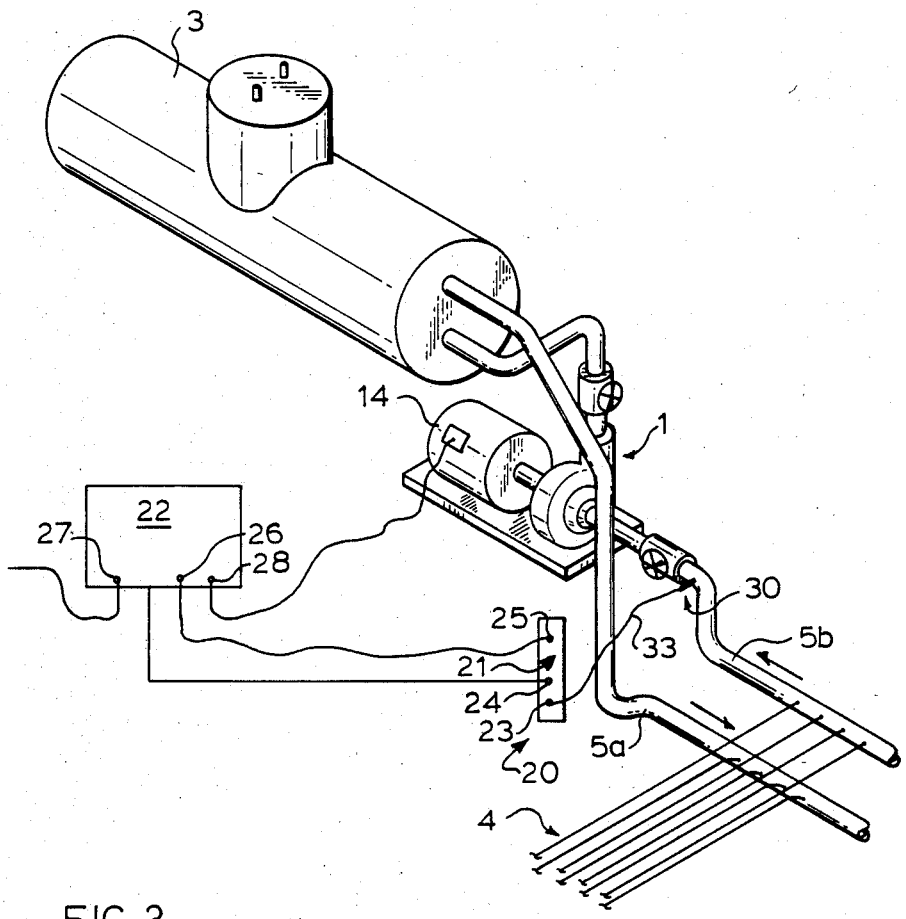
FIG. 2 illustrates a preferred embodiment of the control apparatus of the present invention.

Referring now to FIG. 2, the control apparatus of the preferred embodiment of the present invention comprises thermal load sensing means 20 and motor drive means 22. Thermal load sensing means 20 detects fluctuations in the thermal load on the ice slab caused by variables such as periodic ice re-surfacing operations, variations in ceiling lighting, the number of skaters or curlers on the ice, the size of audience if any, and the rink air temperature. The thermal load sensing means 20 of the preferred embodiment comprises temperature detecting means 20 which detects the fluctuations in the temperature of the circulating brine, and drive control means 21, which generates a signal correlatable with such fluctuations for input into motor drive means 22.

It will be appreciated that the temperature of the brine is correlatable with the fluctuations in the thermal load on the ice slab, for as the thermal load decreases, the frequency of the brine temperature fluctuations also decreases. In other words, the brine tends to stay colder longer at reduced heat loads with the result that the brine temperature fluctuates more slowly as the function of time (this usually results in the refrigeration compressor operating less frequently).

Figure 3:
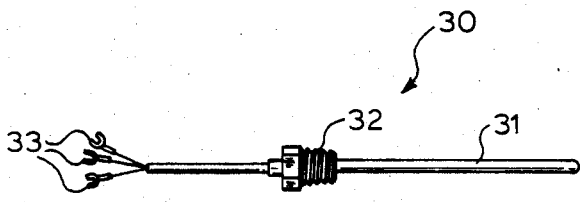
FIG. 3 is a detailed view of the temperature detecting means of the preferred embodiment.

FIG. 3 is a detailed view of temperature detecting means 30, which is preferably a resistance temperature detector comprising a platinum wire encapsulated in a ceramic material which is fixed into a stainless steel jacket 31, a coupling 32, and three output leads 33. Temperature detecting means 30 is preferably a one thousand ohm nominal resistance temperature detector capable of accurately measuring temperature changes on the order of 2° F. (approximately 1° C.) at temperatures below 32° F. Of course, other types of temperature detectors could be used.

Temperature detecting means 30 is preferably placed directly into the output brine line 5*b* as shown in FIG. 1. Alternatively, detecting means 30 could be placed into the input brine line 5*a*, or it could be placed in the ice slab as is the case in the alternative embodiment described below.

Drive control means 21 preferably comprises a millivott to milliamp signal transmitter which generates a current signal directly propotional to the output resistance of temperature detecting means 30. The signal transmitter preferably produces a 4 mA–20 mA or 0–10 Volt D.C. reference signal, for input into motor drive means 22. A suitable transmitter is commercially available from Versatile Measuring Instruments, Inc.

Motor drive means 22 is a variable speed drive, sometimes referred to as an inverter, which is coupled to the drive control means and is capable of converting a fixed voltage, fixed frequency input power signal into a variable frequency, varible voltage, output signal proportional to the drive control means reference signal. The output of the motor drive means 22 can be controlled so as to drive the pump motor 14 at varying speeds, ranging for example from its usual maximum speed to a pre-selected minimum speed. In the preferred embodiment, motor drive means 22 comprises a commercially availabe transistorized AC adjustable speed drive inverter such as that made by Toshiba, which produces an output signal proporational to a 4 mA–20 mA input reference signal.

As shown in FIG. 2, the output leads of temperature detecting means 30 are connected to the input terminals 23 of drive control means 21, and the output terminal 25 of drive control means 21 is connected to the input reference signal terminal 26 of motor drive means 22. The input power line is connected to the input power terminals 27 of motor drive means 22, and the output terminals 28 of motor drive means 22 are connected to the power input terminals of the pump motor 14. Power terminal 24 of drive control means 21 may be connected to a 115 volt, 60 cycle power line from motor drive means 22 or to a separate power supply.

Preferably, the reference signal of drive control means 21 is selected to be directly proportional to the temperature fluctuations detected by temperature detecting means 30. Likewise, it is preferable that the output signal of the motor drive means 22 be directly proportional to the reference signal of drive control means 21, so that the control apparatus of the present invention drives the pump motor at a speed which is directly proportional to the fluctuations in brine temperature.

The motor drive means 22 may be calibrated to produce a minimum output signal for driving the pump motor at a pre-selected reduced speed, which may be field adjustable. This minimum speed can be empirically determined for each refrigeration system, and should be high enough:

(a) to prevent freeze-up in the compressor chiller;

(b) to avoid excessive cycling of the refrigerant compressor; and (c) to avoid cavitation caused by the inlet pressure of the pump falling below the net positive suction head.

In the case of a refrigerant plant which is set up such that the compressor turns on when the brine temperature reaches a maximum temperature (e.g. 19° F.) and shuts off when it reaches a minimum temperature (e.g. 17° F.) it is preferable to calibrate the control apparatus so as to drive the brine pump at maximum power output as the brine temperature reaches its maximum value, so that the brine circulates at maximum speed when the refrigeration compressor is operating. As the compressor operates and as the brine becomes colder, the resistance of the temperature detecting means drops, which results in reducing the reference signal of control means 21, causing drive motor means 22 to reduce its power output, thus dropping the speed of pump motor 14. Preferably, the control apparatus reduces the pump motor speed to its minimum value, when the brine reaches the temperature at which the refrigeration compressor shuts off. As the brine temperature begins to warm, the control apparatus of the present invention causes the pump flow to increase, and once again to reach a maximum value about the same point in time as the refrigeration compressor is once again activated.

The control apparatus of the present invention will conserve energy during periods of less than maximum heat load. During such period (e.g. the winter months), the refrigeration system is over-designed; therefore, the flow rate of brine, which is directly proportional to the pump speed, can be reduced without sacrificing ice quality. Running the pump motor at a reduced speed greatly reduces the power consumption by the pump motor, since the power consumption is proportional to the cube of the pump speed. Moreover, heat generated by the friction caused by the flowing brine (for example, a 25 HP brine pump operating continually at maximum speed is equivalent to a 20 KW electric heater in the ice slab) is decreased as the brine flow is decreased, thus reducing the cost of operating the chiller compressor.

Figure 4:
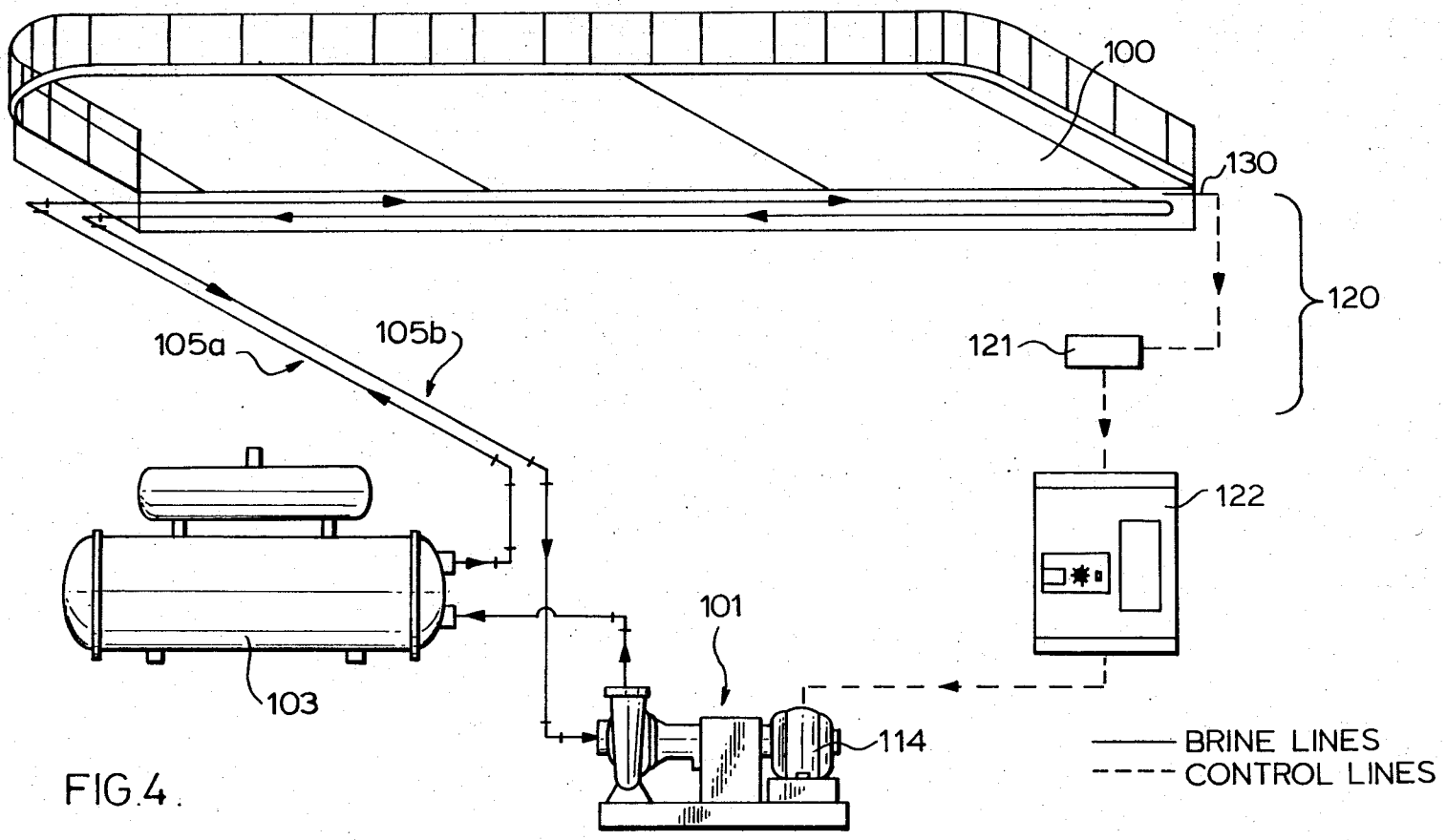
FIG. 4 illustrates an alternative embodiment of the control apparatus of the present invention.

FIG. 4 illustrates an alternative embodiment of the control apparatus of the present invention, comprising thermal load sensing means 120 and motor drive means 122. Thermal load sensing means 120 comprises ice slab temperature sensor 130, and set point controller 121. Motor drive means 122 is preferably an adustable speed drive inverter like inverter 22 of the preferred embodiment. Ice slab temperature sensor 130 is preferably a resistance temperature detector, generally like temperature detecting means 30 of the preferred embodiment, which is adapted for insertion into the ice slab 100, preferably in a relatively warm area of the ice slab, so as to monitor the fluctuations in the ice slab, and preferably to generate an ohmic signal directly proportional to the such temperature fluctuations. Pump 101 pump motor 114, brine chiller 103, and brine lines 105*a*, 105*b* are similar to their counterparts described with reference to FIG. 2.

Set point controller 121 receives the signal of the ice slab temperature sensor 130, and compares that signal with a pre-determined set point, which is selected depending upon a number of factors. For example, for an ice slab having a thickness of one inch, 22° F. might be satisfactory for hockey, 24° F. might be satisfactory for curling, 26° F. might be satisfactory for figure skating, etc. Set point controller 121 periodically compares the ice slab temperature with set point temperature. If the ice slab temperature is greater than the set point temperature, set point controller 121 sends a reference signal to motor drive means 122 directing it to increase the speed of pump motor 114. Likewise, if the signal received from temperature sensor 130 corresponds to an ice slab temperature less than the set point temperature, set point controller 121 will generate an output reference signal directing motor drive means 122 to decrease the speed of pump motor 114. The reference signals generated by the set point controller could comprise, for example, a 4 mA signal in response to an ice slab temperature below the set point, and a 20 mA signal in response to an ice slab temperature above the set point, which would cause motor drive means 122 to drive the pump motor alternately at high and low speeds. Alternatively, the reference signal could be proportional to the difference between the set point temperature and the ice slab temperature. A further alternative is to increase/decrease the reference signal after a given interval of time, as soon as the ice slab temperature remains above/below the set point temperature, until the maximum/minimum reference signal value is achieved.

It may be necessary or desirable, when utilizing this alternative embodiment of the invention, to coordinate the operation of the brine pump and refrigeration compressor, to ensure, for example, that the refrigeration compressor operates when the pump motor is running at high speeds. This can be achieved, for example, by also controlling the operation of the compressor by set point controller 121. Moreover, it may be desirable to drive the compressor motor at variable speeds by means of a variable speed drive like motor drive means 122.

It will be appreciated that a motor drive means other than an alternating current inverter can be used as part of the control apparatus of the present invention. For example, a direct current converter could be used to power a brine pump having a D.C. motor. Moreover, motor drive means other than a variable speed drive could be used; for example, an eddy current clutch or mechanical means such as continuously variable transmission (e.g. a variable pitch belt), could be used to drive the pump motor at variable speeds.

It will also be apparent that the thermal load sensing means is not limited to the temperature detecting means of the preferred and alternative embodiments. One alternative is a non-contact thermometer such as a spot radiometer mounted above and directed at the ice surface.

Another alternative thermal sensing means is compressor suction pressure detecting means, which measures the suction pressure on the refrigeration compressor, for in some refrigeration plants, the compressor operation is controlled according to the refrigerant pressure in the suction line from the brine chiller. A change in brine temperature causes a change in refrigerant vaporization which in turn changes the suction line pressure. Thus, suction like pressure is correlatable with the brine temperature which, as noted above, is correlatable with the ice slab heat load. Compressor suction pressure detecting means could comprise a pressure transducer, which sends a current signal proportional to the pressure to the motor drive means.

Furthermore, while the control apparatus has been described specifically with reference to controlling a brine pump motor, it will be apparent that it could also be utilized to control the operation of other ice slab refrigeration equipment motors, such as a refrigeration compressor motor.

The method of the present invention may comprise the steps of: (a) detecting variations in the ice slab temperature; (b) generating an output signal correlatable with the variations in the ice slab temperature; (c) making a comparison between the output signal and a predetermined ice slab temperature value; (d) generating a reference signal correlatable with the said comparision; and (e) adjusting the speed of the motor in response to the reference signal.

Alternatively, if comparing means such as a set point controller is not used, the method may comprise the steps of: (a) detecting variations in the ice slab thermal load; (b) generating an output signal correlatable with the thermal load variations; and (c) adjusting the speed of the motor in response to the output signal.

While the present invention has been described and illustrated with respect to the preferred and alternative embodiments, it should be understood that numerous variations of these embodiments may be made without departing from the scope of the invention, which is defined in the appended claims.

We claim:

1. A control system for controlling the speed of a centrifugal coolant pump for pumping secondary coolant used in refrigerating an ice slab, comprising:

(a) temperature sensing means embedded in the ice slab for determining ice slab temperature;

(b) control means responsive to the temperature sensing means for generating an output signal correlatable with the ice slab temperature and at least one reference temperature; and (c) variable speed motor drive means responsive to the control means for varying the speed of the pump from a pre-selected maximum speed to a pre-selected non-zero minimum speed in accordance with the output signal of the control means.

2. The control system of claim 1, wherein the pump is a brine pump and the secondary coolant is brine.

3. The control system of claim 1, wherein the said minimum speed is selected to prevent pump cavitation and chiller freeze-up.

4. The control system of claim 1, wherein the control means includes comparing means for making a comparison between the ice slab temperature and the at least one reference temperature and for generating an output control signal in accordance with said comparison.

5. The control system of claim 1, wherein the variable speed drive means drives the pump at an infinitely variable speed over a range of reference temperatures.

6. The control system of claim 5, wherein the infinitely variable speed is directly proportional to the ice slab temperature.

7. The control system of claim 1, wherein the temperature sensing means is a resistance temperature detector which generates an ohmic output signal proportional to the ice slab temperature.

8. The control system of claim 1, wherein the variable speed motor drive means comprises an inverter.

9. The control system of claim 1, wherein the pre-selected maximum speed is the normal operating speed of the pump.

10. A control system for continuously controlling the speed of a brine pump for pumping brine used in refrigerating an ice-slab, comprising:

(a) a resistance temperature detector embedded in the ice slab for determining ice slab temperature and for generating an ohmic signal correlatable therewith;

(b) control means responsive to the resistance temperature detector, including comparing means for making a comparison between the ohmic signal received from the resistance temperature detector and reference signals representing a range of reference temperatures, and for generating an output control signal in accordance with said comparison; and (c) variable speed motor drive means responsive to the control signal of the control means, comprising an inverter for driving the brine pump at an infinitely variable speed ranging from a maximum speed to a pre-selected non-zero minimum speed, said variable speed being directly proportional to the ice slab temperature over said range of reference temperatures, said non-zero minimum speed being selected to prevent brine pump cavitation and chiller freeze-up.

* * * * *